US007758434B1

(12) United States Patent
Johnson

(10) Patent No.: US 7,758,434 B1
(45) Date of Patent: Jul. 20, 2010

(54) PORTABLE WATERSLIDE AND ASSOCIATED METHOD

(76) Inventor: Ray Johnson, 2236 Edelweiss St., Oxnard, CA (US) 93030

( * ) Notice: Subject to any disclaimer, the term of this patent is extended or adjusted under 35 U.S.C. 154(b) by 285 days.

(21) Appl. No.: 12/151,847

(22) Filed: May 9, 2008

Related U.S. Application Data

(60) Provisional application No. 60/928,492, filed on May 10, 2007.

(51) Int. Cl.

| | |
|---|---|
| ***E03B 11/00*** | (2006.01) |
| ***E03B 3/18*** | (2006.01) |
| ***A63G 21/18*** | (2006.01) |
| ***A63G 21/00*** | (2006.01) |
| ***A63G 21/10*** | (2006.01) |
| ***E04H 4/00*** | (2006.01) |

(52) U.S. Cl. ..... 472/117; 472/92; 472/116; 472/128; 4/506

(58) Field of Classification Search ..... 472/116, 472/117, 92, 128; 4/506
See application file for complete search history.

(56) References Cited

U.S. PATENT DOCUMENTS 2,982,547 A 5/1961 Carrier
4,805,898 A * 2/1989 Jacober et al. ..... 472/117
5,387,158 A * 2/1995 Bertrand ..... 472/117
5,548,851 A * 8/1996 Wien et al. ..... 4/506
5,820,471 A * 10/1998 Briggs ..... 472/128
6,312,341 B1 11/2001 Healy
6,692,257 B1 2/2004 Branum
7,040,994 B2 * 5/2006 Lochtefeld et al. ..... 472/117

* cited by examiner

*Primary Examiner*—Gene Kim
*Assistant Examiner*—Michael D Dennis

(57) ABSTRACT

A portable waterslide device includes a plurality of interconnected pivotal sections situated at an end-to-end pattern. The sinusoidal top surface further includes a plurality of spray valves. The portable waterslide device further includes a plurality of motorized discharge nozzles operably coupled to the plurality of spray valves. The portable waterslide device further includes a plurality of equidistantly spaced egress points and a threaded ingress point in fluid communication with a conduit positioned on a rear surface of the portable waterslide device. The portable waterslide device further includes a vertically adjustable pedestal member directly attached to the sliding board, a vertically adjustable ladder operably coupled to the vertically adjustable pedestal member, and a plurality of sensors communicatively coupled to the plurality of spray valves of the sliding board.

16 Claims, 5 Drawing Sheets

PORTABLE WATERSLIDE AND ASSOCIATED METHOD

CROSS REFERENCE TO RELATED APPLICATIONS

This application claims the benefit of U.S. Provisional Application No. 60/928,492, filed May 10, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to slides and, more particularly, to a portable waterslide for providing users with a convenient water based activity that they can enjoy at their own leisure in their own backyard.

2. Prior Art

Waterslides generally include an inclined water conveying course having an entry pool at an upper end and an exit pool at a lower end with a flow of water between the entry and the exit pools. A waterslide user slides down the course on a conveyance means, such as a flexible plastic mat, with the water acting as a lubricant. Generally, the slide course is arranged along a sinuous or serpentine path which enhances the amusement value of the slide.

One waterslide device in use is disclosed in the prior art that provides a slide course formed as a unitary structure from concrete. The course is embedded in the downward sloping portion of a hill and generally follows the terrain of the hill. An entry pool is provided at the upper end of the course and an exit pool is provided at the lower end of the course with a flow of water between the entry and exit pools. Waterslides utilizing the aforementioned embedded concrete structure suffer from a number of drawbacks which limit their application.

Since the slide course must be embedded in a ground formation having a downward slope, substantial earth moving operations may be required to either alter an existing formation or construct an entirely manmade formation to receive the waterslide. Additionally, skilled concrete workers, including casting form erectors, reinforcing bar installers, and finishers are needed to construct the waterslide. When the slide course is completed, its interior surface must be periodically coated with a material or compound which waterproofs the course and provides a smooth surface to prevent abrasion injuries to the waterslide users and to minimize friction between the conveying mat and the slide surfaces.

Furthermore, construction and use of such waterslides are impractical for private use, thus requiring that a person pay an entrance fee to a water park or the like in order to enjoy this type of activity. The aforementioned concrete slides are also, obviously, not portable nature, thus limiting their use to one location. Although small scale waterslides for private use in conjunction with a pool are known in the prior art, these slides are also typically embedded within the deck surrounding the pool, which limits their use to one location only as well.

Accordingly, a need remains for a portable waterslide in order to overcome the above-noted shortcomings.

BRIEF SUMMARY OF THE INVENTION

In view of the foregoing background, it is therefore an object of the present invention to provide an apparatus for providing users with a convenient water based activity that they can enjoy at their own leisure in their own backyard. These and other objects, features, and advantages of the invention are provided by a portable waterslide device.

A portable waterslide device for providing users with a convenient water based activity includes a plurality of controllers and a sliding board. The sliding board includes a sinusoidal top surface including a plurality of interconnected pivotal sections situated at an end-to-end pattern. The top surface further includes a plurality of spray valves disposed along a top of one of the pivotal sections for directing a water flow onto an entire surface area of the sliding board. The plurality of spray valves are positioned at the top surface of the sliding board and are communicatively coupled to the plurality of controllers.

The portable waterslide device further includes a plurality of motorized discharge nozzles operably coupled to the plurality of spray valves and being in fluid communication therewith. The plurality of motorized discharge nozzles distribute the water flow onto the entire surface area of the sliding board. The portable waterslide device further includes a plurality of equidistantly spaced egress points parametrically positioned on each side of the top surface of the sliding board, a threaded ingress point in fluid communication with a conduit positioned on a rear surface of the portable waterslide device. The conduit is selectively connected to a movable source of water.

The portable waterslide device further includes a vertically adjustable pedestal member directly attached to the sliding board, a vertically adjustable ladder operably coupled to the vertically adjustable pedestal member, and a plurality of sensors communicatively coupled to the plurality of spray valves of the sliding board. The plurality of sensors are communicatively coupled to the plurality of controller for allowing a user to adjust a discharge angle and a water flow rate of the plurality of spray valves.

The plurality of spray valves comprise a main valve and a plurality of auxiliary valves in fluid communication therewith and arranged in such a manner that the main valve is directly coupled to the movable source of water and located upstream of the auxiliary spray valves respectively.

Each controller includes a processor communicatively coupled to the plurality of sensors for receiving a plurality of input signals from the plurality of sensors, and a memory electrically coupled to the processor. The memory includes software instructions that cause the portable waterslide device to execute a control logic algorithm that selectively and evenly distributes the water flow onto the entire surface area of the sliding board. The processor is further communicatively coupled to the plurality of spray valves and the plurality of motorized discharge nozzles via a timer activated switch for sending output signals to the plurality of spray valves and further to the plurality of motorized discharge nozzles and thereby adapting the discharge angle and the water flow rate based upon a sliding surface moisture level detected by the sensors.

The control logic algorithm comprises the steps of: the plurality of sensors detecting the moisture level across the top surface of the sliding board; the plurality of sensors generating and transmitting a plurality of first signals to the controller if the moisture level is below a minimum threshold moisture level; the controller determining a location of low moisture levels; the controller automatically biasing the plurality of spray valves between open and closed positions based upon the detected low moisture levels locations; and the controller generating and transmitting the plurality of output signals to the plurality of motorized discharge nozzles and thereby toggling the plurality of discharge nozzles along mutually exclusive pivot paths for spraying water on the low moisture level locations.

The plurality of spray valves oscillate back and forth for directing the water flow onto the sliding board. The plurality of egress points are evenly distribute water across the top surface of the sliding board. Further, the plurality of egress points provide a continuous cascade of water along the top surface of the sliding board. The plurality of sensors are positioned on the top surface of the sliding board. The movable source of water is a water flow from a garden hose and the like.

A method for using the portable waterslide device and providing users with a convenient water based activity includes: providing a plurality of controllers; providing a sliding board by performing the following steps: providing a sinusoidal top surface including a plurality of interconnected pivotal sections situated at an end-to-end pattern, providing and disposing a plurality of spray valves along a top one of the pivotal sections for directing a water flow onto an entire surface area of the sliding board, positioning the plurality of spray valves at the top surface of the sliding board by providing and communicatively coupling a main valve to a plurality of auxiliary valves such that the main valve is directly coupled to the movable source of water and located upstream of the auxiliary spray valves respectively, communicatively coupling the plurality of spray valves to the plurality of controllers, providing and operably coupling a plurality of motorized discharge nozzles to the plurality of spray valves such that the plurality of motorized discharge nozzles are in fluid communication therewith; configuring the plurality of motorized discharge nozzles to distribute the water flow onto the entire surface area of the sliding board; and providing and parametrically positioning a plurality of equidistantly spaced egress points on each side of the top surface of the sliding board.

The method further includes providing a threaded ingress point in fluid communication with a conduit positioned on a rear surface of the portable waterslide device; adapting and selectively connecting the conduit to a movable source of water; providing and directly attaching a vertically adjustable pedestal member to the sliding board; providing and operably coupling a vertically adjustable ladder to the vertically adjustable pedestal member; providing and communicatively coupling a plurality of sensors to the plurality of spray valves of the sliding board; and communicatively coupling the plurality of sensors to the plurality of controllers for allowing a user to adjust a discharge angle and a water flow rate of the plurality of spray valves.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

| DESCRIPTIVE KEY | |
|---|---|
| 10 | portable waterslide device |
| 15 | controllers |
| 20 | sliding board |
| 25 | top surface |
| 30 | spray valves |
| 35 | discharge nozzles |
| 40 | water flow |
| 45 | egress points |
| 50 | threaded ingress point |
| 55 | rear surface |
| 60 | conduit |
| 65 | pedestal member |
| 70 | ladder |
| 75 | sensors |
| 80 | processor |
| 85 | memory |
| 90 | timer activated switch |
| 95 | pivotal sections |

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
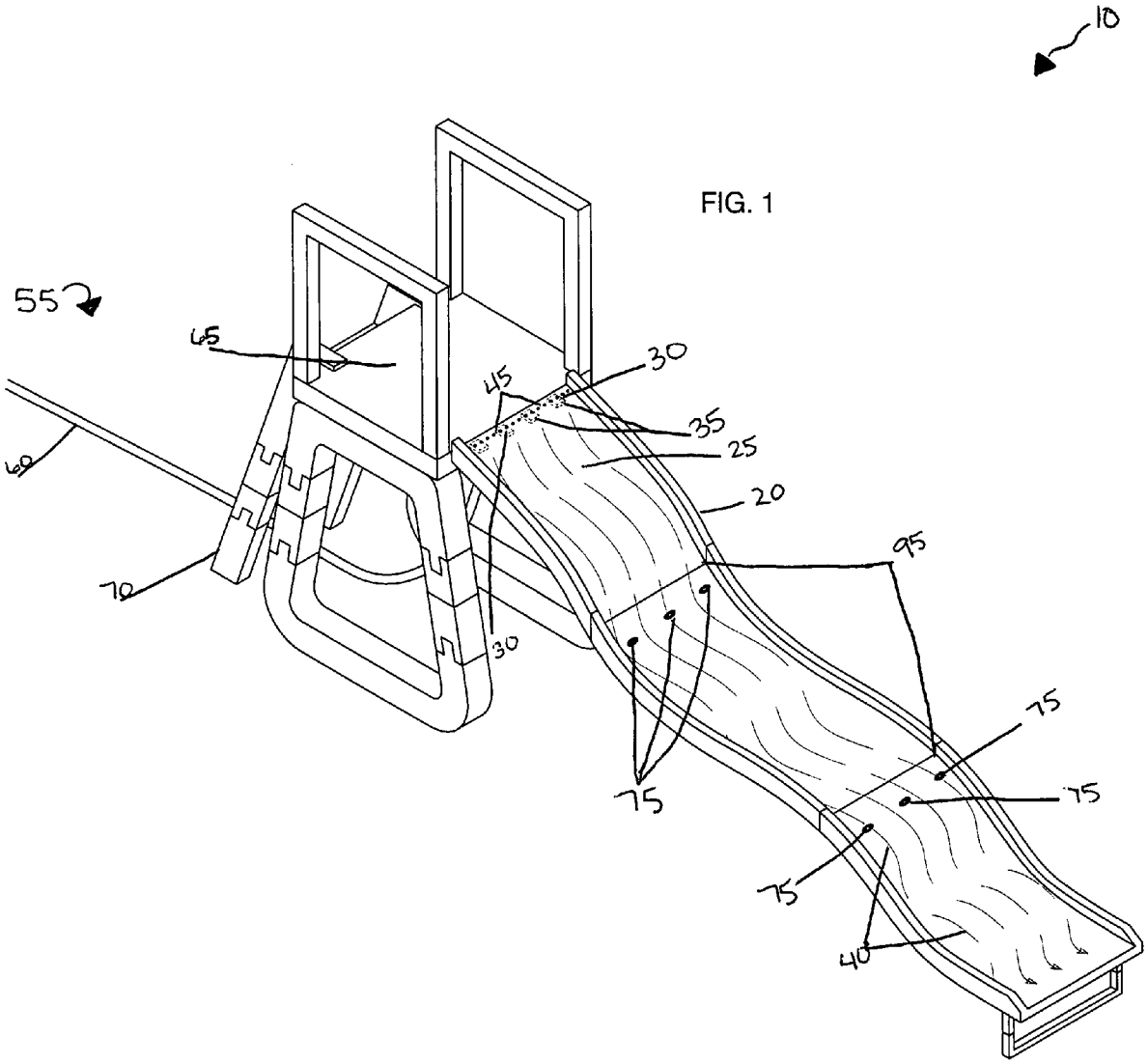
FIG. 1 is a perspective view showing a portable waterslide device for providing users with a convenient water based activity, in accordance with an aspect of the present invention.
Figure 2:
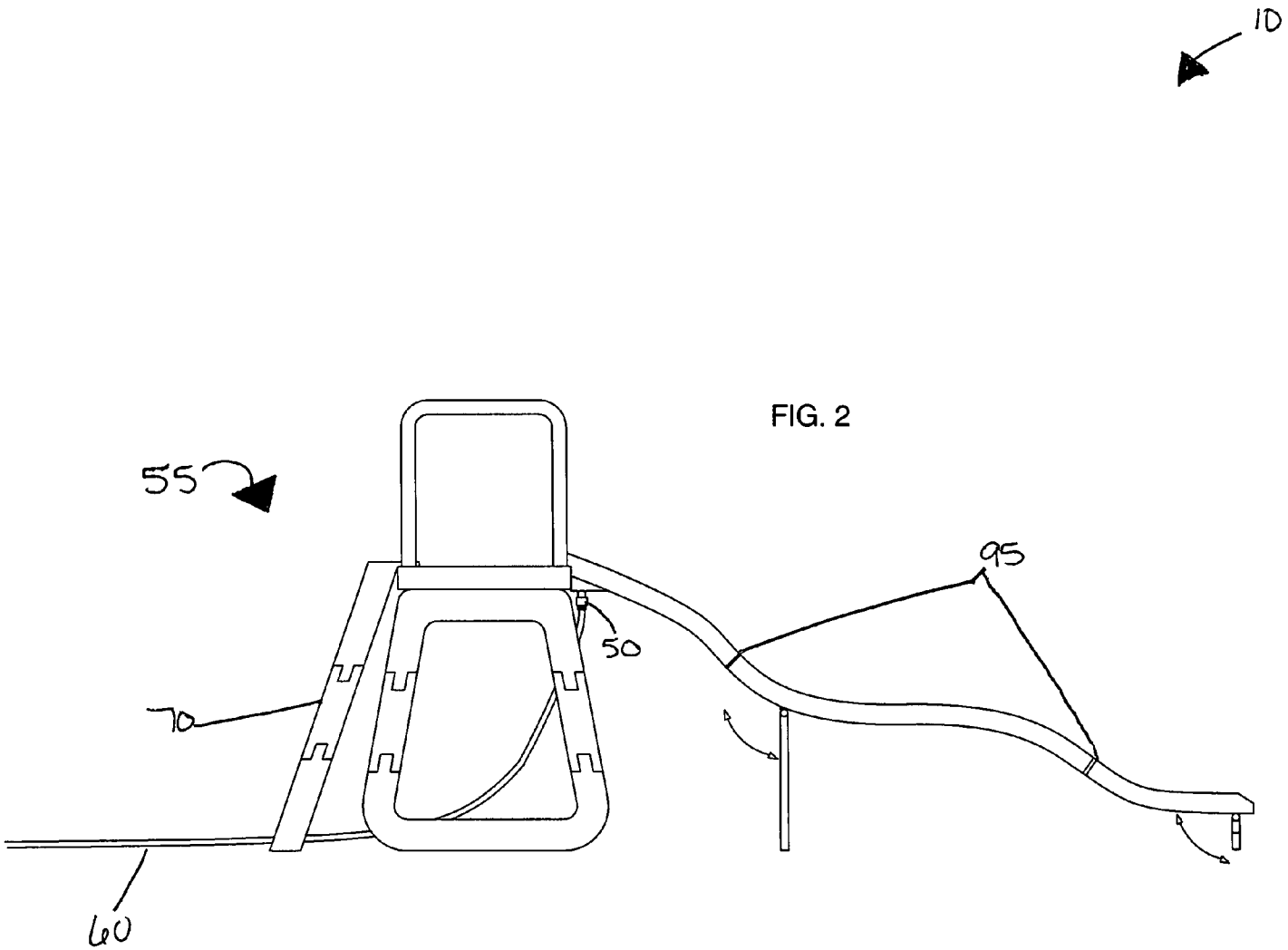
FIG. 2 is a side view showing the portable waterslide device for providing users with a convenient water based activity, in accordance with an aspect of the present invention.
Figure 3:
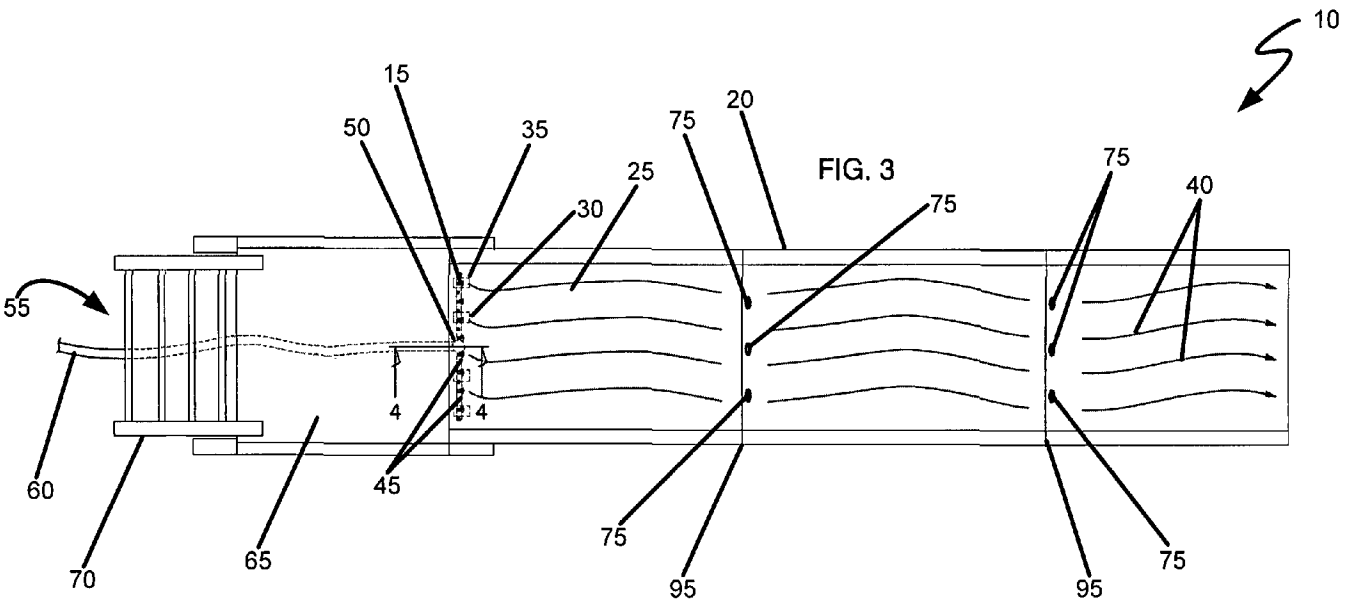
FIG. 3 is a top view showing the portable waterslide device for providing users with a convenient water based activity, in accordance with an aspect of the present invention.
Figure 4:
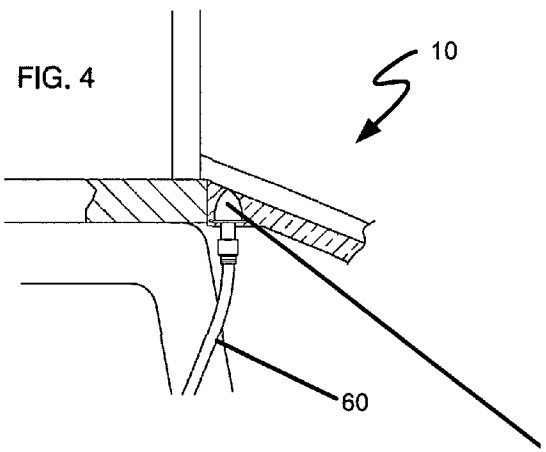
FIG. 4 is an exploded view showing the portable waterslide device for providing users with a convenient water based activity, in accordance with an aspect of the present invention.
Figure 5:
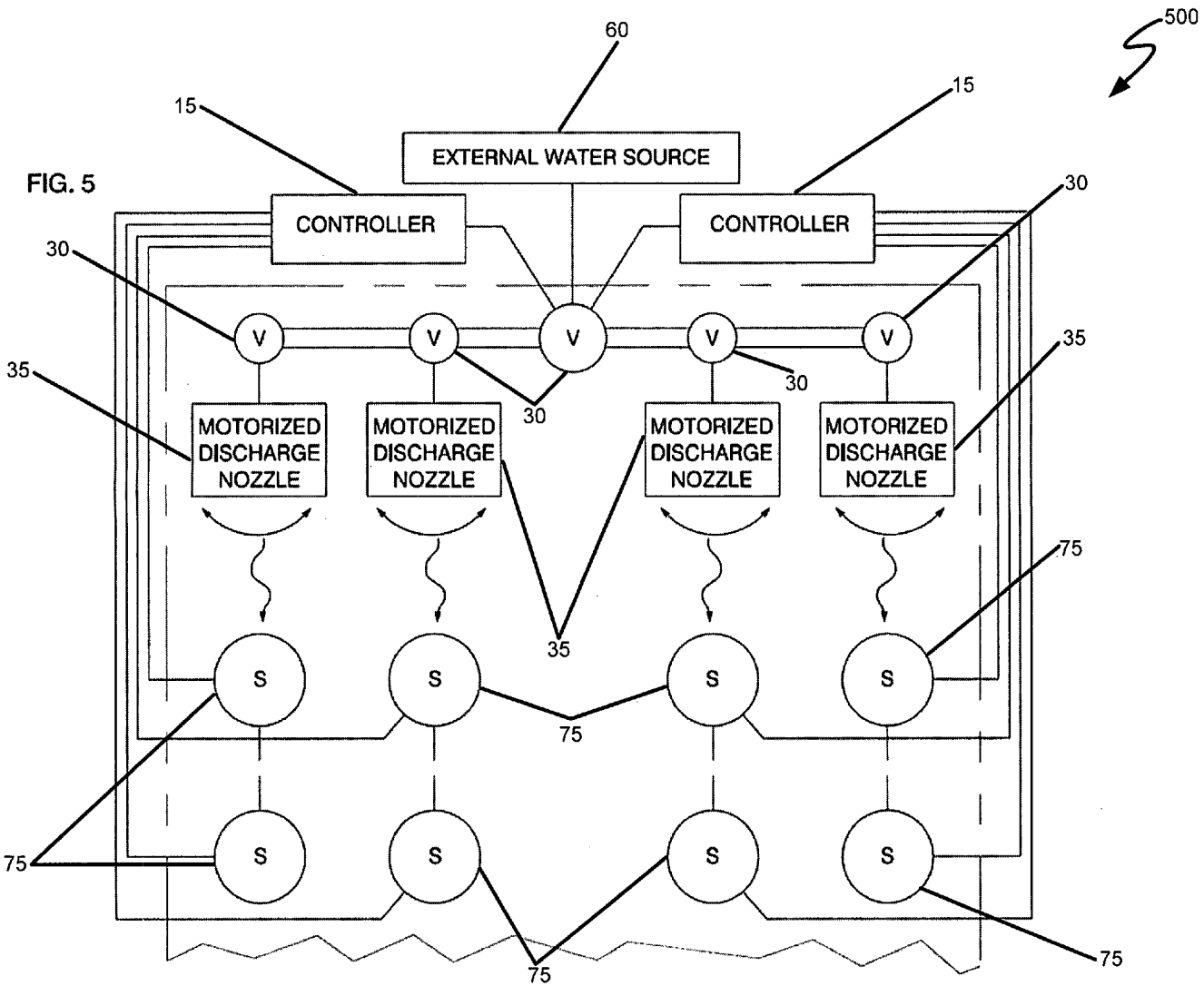
FIG. 5 is a schematic diagram 500 showing various connections in the portable waterslide device for providing users with a convenient water based activity, in accordance with an aspect of the present invention.
Figure 6:
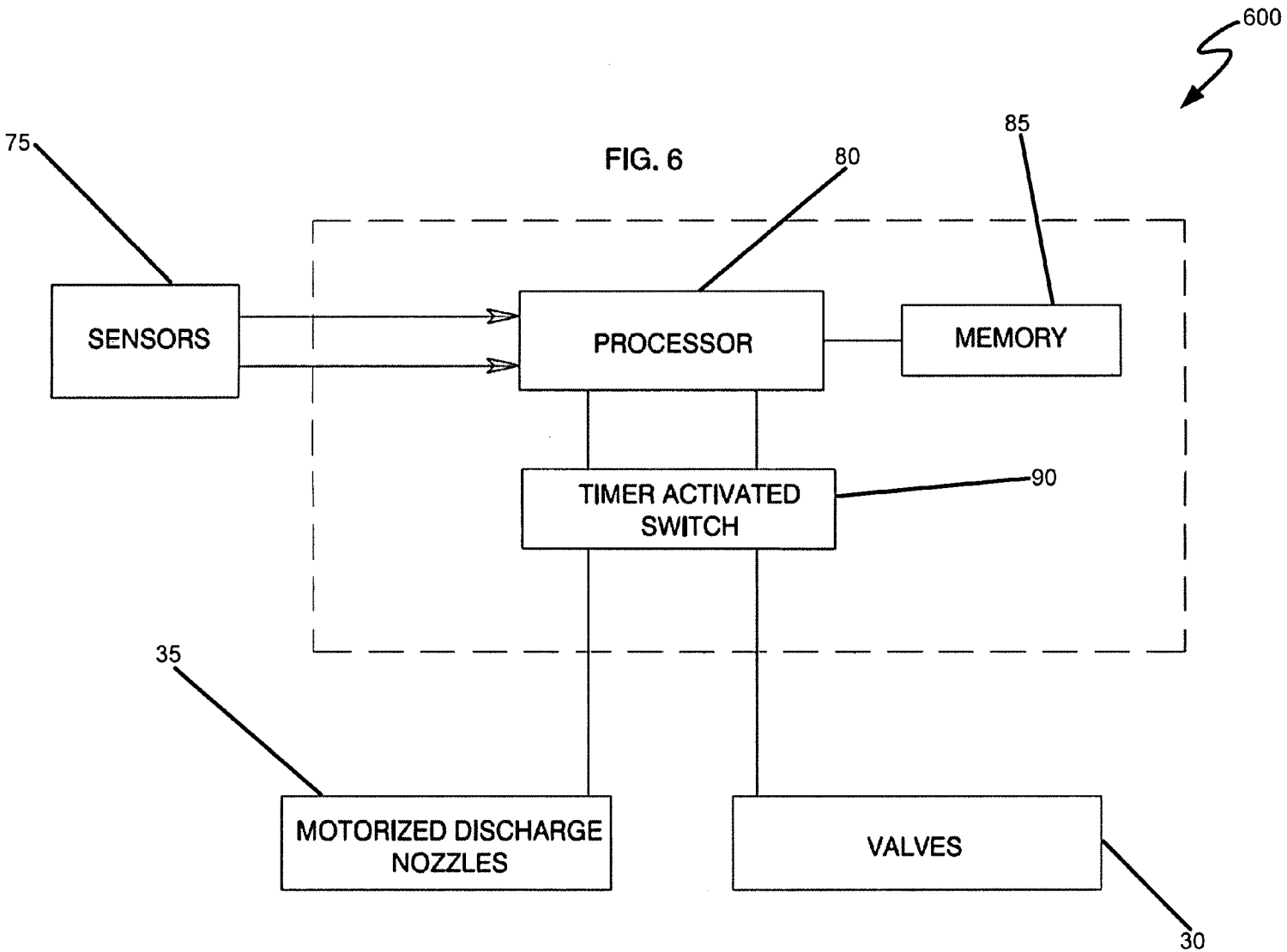
FIG. 6 is a schematic diagram 600 showing an operation of the portable waterslide device for providing users with a convenient water based activity, in accordance with an aspect of the present invention.

The apparatus of this invention is referred to generally in FIGS. 1-6 by the reference numeral 10 and is intended to provide a portable waterslide. It should be understood that the assembly may be used for providing a waterslide in many different types of applications and should not be limited in use to only being used in conjunction with a pool or the like.

Now referring to FIGS. 1, 2, 3, 4, 5 and 6 a portable waterslide device 10 for providing users with a convenient water based activity includes a plurality of controllers 15 and a sliding board 20. The sliding board 20 includes a sinusoidal top surface 25 including a plurality of interconnected pivotal sections 95 situated at an end-to-end pattern. The top surface 25 further includes a plurality of spray valves 30 disposed along a top of one of the pivotal sections 95 for directing a water flow 40 onto an entire surface area of the sliding board 20. The plurality of spray valves 30 are positioned at the top surface 25 of the sliding board 20 and are communicatively coupled to the plurality of controllers 15.

The portable waterslide device 10 further includes a plurality of motorized discharge nozzles 35 operably coupled to the plurality of spray valves 30 and being in fluid communication therewith. The plurality of motorized discharge nozzles 35 distribute the water flow 40 onto the entire surface area of the sliding board 20. The portable waterslide device 10 further includes a plurality of equidistantly spaced egress points 45 parametrically positioned on each side of the top surface 25 of the sliding board 20, a threaded ingress point 50 in fluid communication with a conduit 60 positioned on a rear surface 55 of the portable waterslide device 10. The conduit 60 is selectively connected to a movable source of water.

The portable waterslide device 10 further includes a vertically adjustable pedestal member 65 directly attached to the sliding board 20, a vertically adjustable ladder 70 operably coupled to the vertically adjustable pedestal member 65, and a plurality of sensors 75 communicatively coupled to the plurality of spray valves 30 of the sliding board 20. The plurality of sensors 75 are communicatively coupled to the plurality of controllers 15 for allowing a user to adjust a discharge angle and a water flow rate of the plurality of spray valves 30.

The plurality of spray valves 30 include a main valve and a plurality of auxiliary valves in fluid communication therewith and arranged in such a manner that the main valve is directly coupled to the movable source of water and located upstream of the auxiliary spray valves 30 respectively.

In one embodiment, each controller 15 includes a processor 80 communicatively coupled to the plurality of sensors 75 for receiving a plurality of input signals from the plurality of sensors 75, and a memory 85 electrically coupled to the processor 80. The memory 85 includes software instructions that cause the portable waterslide device 10 to execute a control logic algorithm that selectively and evenly distributes the water flow 40 onto the entire surface area of the sliding board 20. The processor 80 is further communicatively coupled to the plurality of spray valves 30 and the plurality of motorized discharge nozzles 35 via a timer activated switch 90 for sending output signals to the plurality of spray valves 30 and further to the plurality of motorized discharge nozzles 35 and thereby adapting the discharge angle and the water flow 40 rate based upon a sliding surface moisture level detected by the sensors 75.

The control logic algorithm comprises the steps of: the plurality of sensors 75 detecting the moisture level across the top surface 25 of the sliding board 20; the plurality of sensors 75 generating and transmitting a plurality of first signals to the controller 15 if the moisture level is below a minimum threshold moisture level; the controller 15 determining a location of low moisture levels; the controller 15 automatically biasing the plurality of spray valves 30 between open and closed positions based upon the detected low moisture levels locations; and the controller 15 generating and transmitting the plurality of output signals to the plurality of motorized discharge nozzles 35 and thereby toggling the plurality of discharge nozzles 35 along mutually exclusive pivot paths for spraying water on the low moisture level locations.

The plurality of spray valves 30 oscillate back and forth for directing the water flow 40 onto the sliding board 20. The plurality of egress points 45 are for evenly distributing water across the top surface 25 of the sliding board 20. Further, the plurality of egress points provide a continuous cascade of water along the top surface 25 of the sliding board 20.

In one embodiment, the plurality of sensors 75 are positioned on the top surface 25 of the sliding board 20. The movable source of water is a water flow from a garden hose and the like.

The present invention, as claimed, provides the unexpected and unpredictable benefit by providing an assembly that is convenient and easy to use, is durable yet lightweight in design, is versatile in its applications, and provides users with a unique, fun-filled means of summertime play. By including streaming jets of water, the present invention provides an instant and spirited new water-based activity, right in one's own backyard. In this manner, children no longer have to beg to be taken to expensive water parks when such fun is conveniently available at home. Delighting in rapidly swooping down the wet slide while water continuously sprays, kids are able to play for hours, curing summertime boredom while also battling the sun's unrelenting heat. The assembly can conveniently be used as a stand alone slide, and can also be used with existing, or newly acquired pools of various sizes, thus making it flexible, versatile and convenient.

In use, a method for using the portable waterslide device 10 and providing users with a convenient water based activity includes: providing a plurality of controllers 15; providing a sliding board 20 by performing the following steps: providing a sinusoidal top surface 25 including a plurality of interconnected pivotal sections 95 situated at an end-to-end pattern, providing and disposing a plurality of spray valves 30 along a top one of the pivotal sections 95 for directing a water flow 40 onto an entire surface area of the sliding board 20, positioning the plurality of spray valves 30 at the top surface 25 of the sliding board 20 by providing and communicatively coupling a main valve to a plurality of auxiliary valves such that the main valve is directly coupled to the movable source of water and located upstream of the auxiliary spray valves 30 respectively, communicatively coupling the plurality of spray valves 30 to the plurality of controllers 15, providing and operably coupling a plurality of motorized discharge nozzles 35 to the plurality of spray valves 30 such that the plurality of motorized discharge nozzles 35 are in fluid communication therewith; configuring the plurality of motorized discharge nozzles 35 to distribute the water flow 40 onto the entire surface area of the sliding board 20; and providing and parametrically positioning a plurality of equidistantly spaced egress points 45 on each side of the top surface 25 of the sliding board 20.

The method further includes providing a threaded ingress point 50 in fluid communication with a conduit 60 positioned on a rear surface 55 of the portable waterslide device 10; adapting and selectively connecting the conduit 60 to a movable source of water; providing and directly attaching a vertically adjustable pedestal member 65 to the sliding board 20; providing and operably coupling a vertically adjustable ladder 70 to the vertically adjustable pedestal member 65; providing and communicatively coupling a plurality of sensors 75 to the plurality of spray valves 30 of the sliding board 20; and communicatively coupling the plurality of sensors 75 to the plurality of controllers 15 for allowing a user to adjust a discharge angle and a water flow rate of the plurality of spray valves 30.

The combination of such claimed elements provides an unpredictable and unexpected result which is not rendered obvious by one skilled in the art. It is envisioned that other styles and configurations of the present invention can be easily incorporated into the teachings of the present invention, and only one particular configuration shall be shown and described for purposes of clarity and disclosure and not by way of limitation of scope.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable waterslide device for providing users with a convenient water based activity, said portable waterslide device comprising: a plurality of controllers; a sliding board comprising a sinusoidal top surface; a plurality of spray valves disposed along said sliding board for directing a water flow onto an entire surface area of said sliding board, said plurality of spray valves being positioned at said top surface of said sliding board and being communicatively coupled to said plurality of controllers, and a plurality of motorized discharge nozzles operably coupled to said plurality of spray valves and being in fluid communication therewith, said plurality of motorized discharge nozzles being configured to distribute said water flow onto said entire surface area of said sliding board; and a plurality of equidistantly spaced egress points parametrically positioned on each side of said top surface of said sliding board; a threaded ingress point in fluid communication with a conduit positioned on a rear surface of said portable waterslide device, said conduit being adapted to be selectively connected to a movable source of water; a vertically adjustable pedestal member directly attached to said sliding board; a vertically adjustable ladder operably coupled to said vertically adjustable pedestal member; and a plurality of sensors communicatively coupled to said plurality of spray valves of said sliding board, said plurality of sensors being further communicatively coupled to said plurality of controllers for allowing a user to adjust a discharge angle and a water flow rate of said plurality of spray valves; wherein each controller of said plurality of controllers comprises: a processor communicatively coupled to said plurality of sensors for receiving a plurality of input signals from said plurality of sensors; and a memory electrically coupled to said processor, said memory including software, instructions that cause said portable waterslide device to execute a control logic algorithm that selectively and evenly distributes said water flow onto said entire surface area of said sliding board; wherein said processor is further communicatively coupled to said plurality of spray valves and said plurality of motorized discharge nozzles via a timer activated switch for sending output signals to said plurality of spray valves and further to said plurality of motorized discharge nozzles and thereby adapting said discharge angle and said water flow rate based upon a sliding surface moisture level detected by said sensors.

2. The portable waterslide of claim 1, wherein said control logic algorithm comprises the steps of: said plurality of sensors detecting said moisture level across said top surface of said sliding board; said plurality of sensors generating and transmitting a plurality of first signals to said controller if said moisture level is below a minimum threshold moisture level; said controller determining a location of low moisture levels; said controller automatically biasing said plurality of spray valves between open and closed positions based upon said detected low moisture levels locations; and said controller generating and transmitting said plurality of output signals to said plurality of motorized discharge nozzles and thereby toggling said plurality of discharge nozzles along mutually exclusive pivot paths for spraying water on said low moisture level locations.

3. The portable waterslide of claim 1, wherein said plurality of spray valves are configured to oscillate back and forth for directing said water flow onto said sliding board.

4. The portable waterslide of claim 1, wherein said plurality of egress points are configured for evenly distributing water across said top surface of said sliding board, said plurality of egress points being further configured to provide a continuous cascade of water along said top surface of said sliding board.

5. The portable waterslide of claim 1, wherein said plurality of sensors are positioned on said top surface of said sliding board.

6. The portable waterslide of claim 1, wherein said movable source of water is a water flow from a garden hose.

7. A portable waterslide device for providing users with a convenient water based activity, said portable waterslide device comprising: a plurality of controllers; a sliding board comprising a sinusoidal top surface including a plurality of interconnected pivotal sections situated at an end-to-end pattern, a plurality of spray valves disposed along a top of one of said pivotal sections for directing a water flow onto an entire surface area of said sliding board, said plurality of spray valves being positioned at said top surface of said sliding board and being communicatively coupled to said plurality of controllers, a plurality of motorized discharge nozzles operably coupled to said plurality of spray valves and being in fluid communication therewith, said plurality of motorized discharge nozzles being configured to distribute said water flow onto said entire surface area of said sliding board; and a plurality of equidistantly spaced egress points parametrically positioned on each side of said top surface of said sliding board; a threaded ingress point in fluid communication with a conduit positioned on a rear surface of said portable waterslide device, said conduit being adapted to be selectively connected to a movable source of water; a vertically adjustable pedestal member directly attached to said sliding board; a vertically adjustable ladder operably coupled to said vertically adjustable pedestal member; and a plurality of sensors communicatively coupled to said plurality of Spray valves of said sliding board, said plurality of sensors being further communicatively coupled to said plurality of controllers for allowing a user to adjust a discharge angle and a water flow rate of said plurality of spray valves; wherein said plurality of spray valves comprises a main valve and a plurality of auxiliary valves in fluid communication therewith and arranged in such a manner that said main valve is directly coupled to said movable source of water and located upstream of said auxiliary spray valves respectively; wherein each controller of said plurality of controllers comprises: a processor communicatively coupled to said plurality of sensors for receiving a plurality of input signals from said plurality of sensors; and a memory electrically coupled to said processor, said memory including software instructions that cause said portable waterslide device to execute a control logic algorithm that selectively and evenly distributes said water flow onto said entire surface area of said sliding board; wherein said processor is further communicatively coupled to said plurality of spray valves and said plurality of motorized discharge nozzles via a timer activated switch for sending output signals to said plurality of spray valves and further to said plurality of motorized discharge nozzles and thereby adapting said discharge angle and said water flow rate based upon a sliding surface moisture level detected by said sensors.

8. The portable waterslide of claim 7, wherein said control logic algorithm comprises the steps of: said plurality of sensors detecting said moisture level across said top surface of said sliding board; said plurality of sensors generating and transmitting a plurality of first signals to said controller if said moisture level is below a minimum threshold moisture level; said controller determining a location of low moisture levels; said controller automatically biasing said plurality of spray valves between open and closed positions based upon said detected low moisture levels locations; and said controller generating and transmitting said plurality of output signals to said plurality of motorized discharge nozzles and thereby toggling said plurality of discharge nozzles along mutually exclusive pivot paths for spraying water on said low moisture level locations.

9. The portable waterslide of claim 8, wherein said plurality of spray valves are configured to oscillate back and forth for directing said water flow onto said sliding board.

10. The portable waterslide of claim 8, wherein said plurality of egress points are configured for evenly distributing water across said top surface of said sliding board, said plurality of egress points being further configured to provide a continuous cascade of water along said top surface of said sliding board.

11. The portable waterslide of claim 8, wherein said plurality of sensors are positioned on said top surface of said sliding board.

12. The portable waterslide of claim 8, wherein said movable source of water is a water flow from a garden hose.

13. A method for using a portable waterslide device and providing users with a convenient water based activity, said portable waterslide device comprising:

a. providing a plurality of controllers;

b. providing a sliding board by performing the following steps i. providing a sinusoidal top surface including a plurality of interconnected pivotal sections situated at an end-to-end pattern, ii. providing and disposing a plurality of spray valves along a top one of said pivotal sections for directing a water flow onto an entire surface area of said sliding board, iii. positioning said plurality of spray valves at said top surface of said sliding board by providing and communicatively coupling a main valve to a plurality of auxiliary valves such that said main valve is directly coupled to said movable source of water and located upstream of said auxiliary spray valves respectively, iv. communicatively coupling said plurality of spray valves to said plurality of controllers, v. providing and operably coupling a plurality of motorized discharge nozzles to said plurality of spray valves such that said plurality of motorized discharge nozzles are in fluid communication therewith;

vi. configuring said plurality of motorized discharge nozzles to distribute said water flow onto said entire surface area of said sliding board; and vii. providing and parametrically positioning a plurality of equidistantly spaced egress points on each side of said top surface of said sliding board;

c. providing a threaded ingress point in fluid communication with a conduit positioned on a rear surface of said portable waterslide device;

d. adapting and selectively connecting said conduit to a movable source of water;

e. providing and directly attaching a vertically adjustable pedestal member to said sliding board;

f. providing and operably coupling a vertically adjustable ladder to said vertically adjustable pedestal member;

g. providing and communicatively coupling a plurality of sensors to said plurality of spray valves of said sliding board; and h. communicatively coupling said plurality of sensors to said plurality of controllers for allowing a user to adjust a discharge angle and a water flow rate of said plurality of spray valves; wherein each controller of said plurality of controllers comprises: a processor communicatively coupled to said plurality of sensors for receiving a plurality of input signals from said plurality of sensors; and a memory electrically coupled to said processor, said memory including software instructions that cause said portable waterslide device to execute a control logic algorithm that selectively and evenly distributes said water flow onto said entire surface area of said sliding board; wherein said processor is further communicatively coupled to said plurality of spray valves and said plurality of motorized discharge nozzles via a timer activated switch for sending output signals to said plurality of spray valves and further to said plurality of motorized discharge nozzles and thereby adapting said discharge angle and said water flow rate based upon a sliding surface moisture level detected by said sensors.

14. The method of claim 13, wherein said control logic algorithm comprises the steps of: said plurality of sensors detecting said moisture level across said top surface of said sliding board; said plurality of sensors generating and transmitting a plurality of first signals to said controller if said moisture level is below a minimum threshold moisture level; said controller determining a location of low moisture levels; said controller automatically biasing said plurality of spray valves between open and closed positions based upon said detected low moisture levels locations; and said controller generating and transmitting said plurality of output signals to said plurality of motorized discharge nozzles and thereby toggling said plurality of discharge nozzles along mutually exclusive pivot paths for spraying water on said low moisture level locations.

15. The method of claim 14, wherein said plurality of spray valves are configured to oscillate back and forth for directing said water flow onto said sliding board.

16. The method of claim 14, wherein said plurality of egress points are configured for evenly distributing water across said top surface of said sliding board, said plurality of egress points being further configured to provide a continuous cascade of water along said top surface of said sliding board.

* * * * *